United States Patent [19]

Laine

[11] 4,081,164

[45] Mar. 28, 1978

[54] FRAMEWORK ASSEMBLY FOR FURNITURE

[76] Inventor: Jacques Pierre Georges Laine, 29, avenue du Gl De Gaulle, 77 Montereau, France

[21] Appl. No.: 366,124

[22] Filed: Jun. 1, 1973

[30] Foreign Application Priority Data

Jun. 8, 1972 France ..... 7220711

[51] Int. Cl.[2] ..... A47B 13/00

[52] U.S. Cl. ..... 248/188.3

[58] Field of Search ..... 248/188.1, 188.3, 182, 248/188.2

[56] References Cited

U.S. PATENT DOCUMENTS

| | | | |
|---|---|---|---|
| 2,208,704 | 7/1940 | Shannon | 248/188.3 |
| 2,787,087 | 4/1957 | Whitman | 248/188.3 |
| 2,793,468 | 5/1957 | Mooser | 248/188.3 |
| 3,117,392 | 1/1964 | Junkunc | 248/188.3 |
| 3,167,290 | 1/1965 | Beckwell | 248/188.3 |
| 3,204,906 | 9/1965 | Henderson | 248/188.3 |
| 3,533,586 | 10/1970 | Chichester | 248/188.3 |
| 3,814,362 | 6/1974 | Ritchie | 248/188.3 |
| 3,855,947 | 12/1974 | Henley et al. | 248/188.3 |

FOREIGN PATENT DOCUMENTS

| | | | |
|---|---|---|---|
| 1,537,888 | 7/1968 | France | 248/188.3 |
| 390,598 | 4/1933 | United Kingdom | 248/188.2 |

*Primary Examiner*—Marion Parsons, Jr.
*Attorney, Agent, or Firm*—Lane, Aitken, Dunner & Ziems

[57] ABSTRACT

A framework assembly for furniture in which two or more leg units are connected in a spaced relationship in a manner to permit relative movement between the leg units to accommodate irregularities in the floor on which the assembly is mounted. The top, or seat, portion of the furniture piece is supported relative to the assembly in a manner to accommodate said relative movement.

5 Claims, 3 Drawing Figures

FRAMEWORK ASSEMBLY FOR FURNITURE

BACKGROUND OF THE INVENTION

This invention relates to a framework assembly for a piece of furniture and, more particularly, to such an assembly for supporting a table top or seat to form a table, desk, pedestal table, wardrobe, chair, or the like.

Furniture pieces with legs, and particularly tables, are often wobbly when placed on a floor which is not perfectly level. This is due to the fact that the framework for the piece, including the legs, along with the top member which is supported by the framework, form a rigid assembly which causes the bottoms of one or more legs to rise above the floor level.

SUMMARY OF THE INVENTION

It is, therefore, an object of the present invention to provide a framework assembly for a piece of furniture in which at least one of the leg units is movable relative to the remaining portions of the assembly to accommodate irregularities in the floor.

Toward the fulfillment of this and other objects, the assembly of the present invention comprises at least two leg units, means for connecting said leg units in a spaced relation to form a sub assembly, said connecting means permitting relative movement between said leg units to accommodate irregularities in the floor on which the assembly is mounted, and means for supporting a table top or seat relative to said sub assembly in a manner to accommodate said relative movement.

DESCRIPTION OF THE PREFERRED EMBODIMENTS

Figure 1:
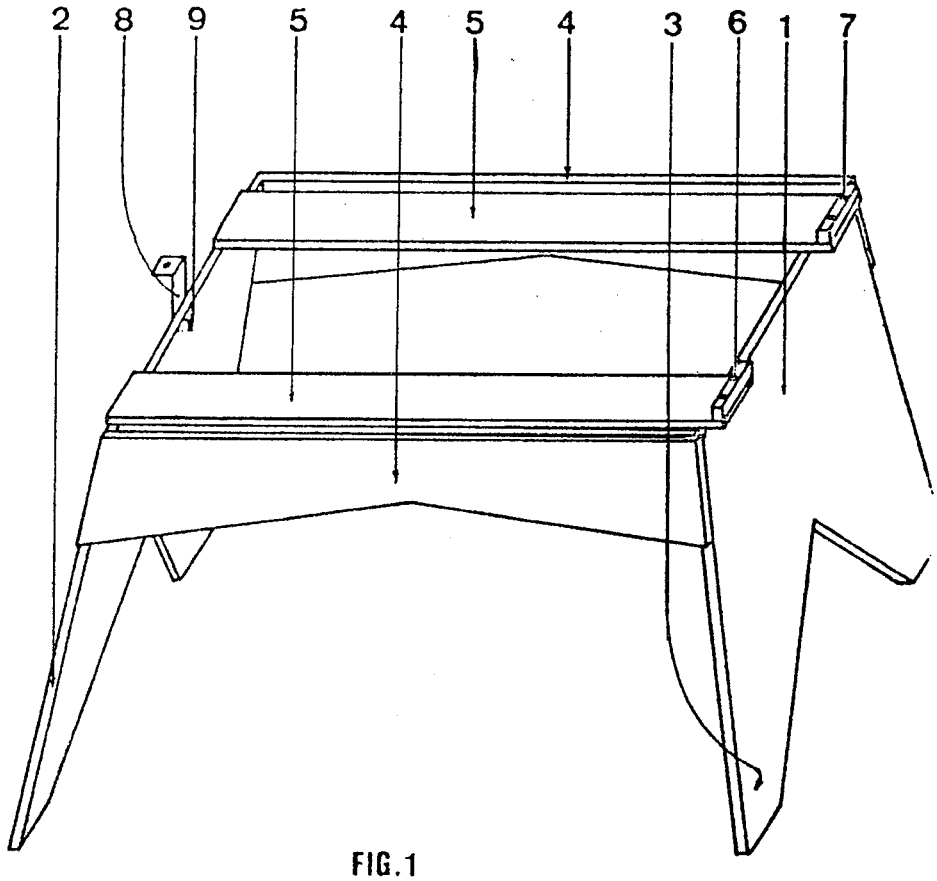
FIG. 1 is a perspective view of one embodiment of the assembly of the present invention.

According to the embodiment of FIG. 1, the framework assembly, which in this example is adapted to support a plate, or top, to form a table, consists of two spaced leg units 1 and 2, each in the form of a wooden panel cut so as to form two supporting legs 3. The leg units 1 and 2 are connected to each other by a pair of stringers 4 connected to the side edges thereof, and a pair of stringers 5 connected to the upper edges thereof. The stringers 4 and 5 are made of wood or any other substance capable of elastic deformation due to relative movement between the two leg units 1 and 2.

The stringers 4 and 5 are connected to the leg units 1 and 2 by fastening members, such as screws or the like, and the square or quadrilateral sub-assembly thus formed is deformable, due to the fact that the elastic stringers 4 and 5 permit relative movement of the leg units so that the legs 3 can adjust to the deformation of the ground or floor.

In order to insure that the relative elasticity of the sub-assembly thus formed will be maintained by the table top (not shown) which it supports, the table top is mounted independent of at least one of the leg units 1 and 2 so that it may move relative thereto.

In particular, the table top can be connected, along one of its lateral sides, to the leg unit 1 at two blocks 6 and 7 fixed at one end to each of the stringers 5, whereas the other lateral side of the table top can be connected relative to the other leg unit 2 by an articulation system, such as a bracket 8 pivotably mounted to the leg unit 2 and defining a surface for receiving the table top. The above connections can be made in any conventional manner, such as by clamps, bolts, screws, etc., extending through holes formed through the blocks 6 and 7 and the bracket 8.

As a result of the above arrangement, the leg unit 2 will move freely with respect to the leg unit 1 and the table top, due to the relative elasticity of the stringers 4 and 5, to accommodate irregularities in the floor on which the assembly is placed.

Figure 2:
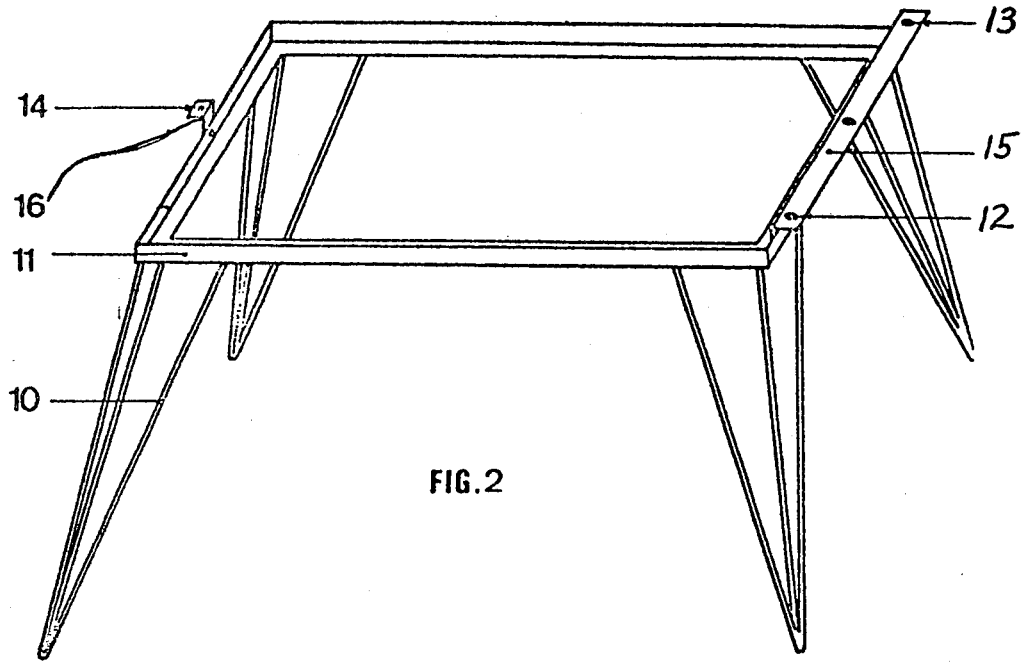
FIGS. 2 and 3 are views similar to FIG. 1 but showing alternate embodiments of the framework assembly of the present invention.

In the embodiment of FIG. 2, four individual legs 10 are connected to an elastically deformable quadrilateral frame 11 made, for example, with metal section pieces for supporting a plate, or top (not shown) to form a table. The assembly thus formed, due to the fact that the relative weight of the table top will be much greater than that of the frame 11, is capable of being deformed due to the relative elasticity of the frame 11.

The table top, as in the example in FIG. 1, is supported relative to the assembly at two fixed points 12 and 13 and at a pivotal point 14. In this respect, an angle iron 15 is attached to one of the lateral sides of the frame 11, with the upper wing thereof defining the points 12 and 13 for attachment to the table top by clamps, bolts, screws, etc.

The pivotal point 14 is defined by a bracket 16 pivotally mounted on the other lateral side of the frame 11 and defining a surface for attachment to the table top to accommodate relative movements between the legs 10 in response to irregularities in the floor, in an identical manner to that discussed above.

Figure 3:
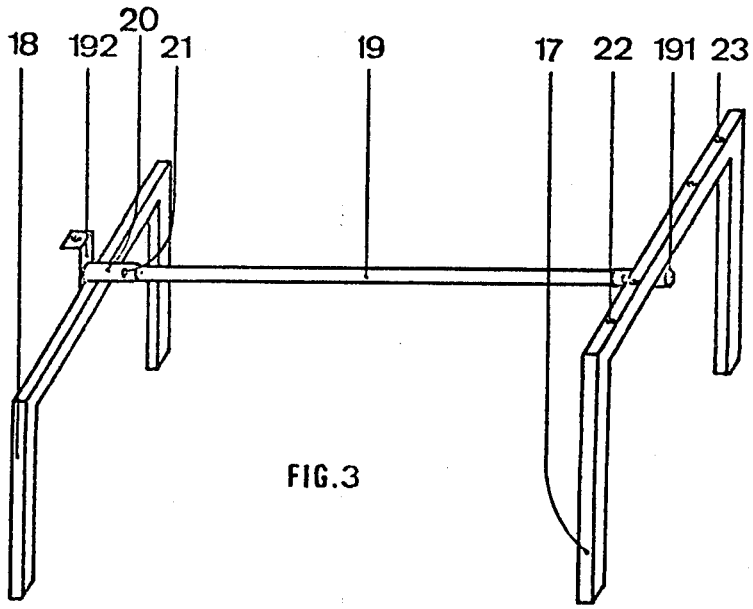

In the example in FIG. 3, two U-shaped leg units 17 and 18, each having a pair of legs, are connected in a spaced relationship by a central tubular stringer 19 having one end 191 fixed to the leg unit 17 via a sleeve extending over the end portion of the stringer 19 and fixed both to the stringer and to the frame member. The other end of the stringer 19 has a bracket 192 fixed thereto which defines a surface for receiving a plate, or top (not shown) to form a table. The leg unit 18 is rotatably mounted with respect to the assembly formed by the stringer 19 and the leg unit 17 by means of a sleeve 20 which is welded, or otherwise fixed, to the leg unit 18 and which is rotatably mounted over a portion of the stringer 19. An opening, or slot, 21 is formed through the sleeve 20 which receives a pin provided on the stringer 19 to limit the angular movement of the leg unit 18 with respect to the stringer 19 and therefore the leg unit 17. The table top is fixed relative to the leg unit 17 at points 22 and 23, and relative to the bracket 192 by means of clamps, bolts, screws, etc., in a conventional manner. As in the previous embodiments, the irregularities of the floor are compensated for by movement of the leg unit 18 relative to the assembly consisting of the tubular stringer 19, the leg unit 17, and the table top.

It is understood that, in each of the above embodiments, the supported member can be made up not only of a table top which is polygonal or curved but also of a flat plate, or the like, of any other shape. Also, the supported member may be in the form of a desk chest, the seat of a chair, or a shelf assembly, such as the chest of a wardrobe or the like. The framework of the present invention is therefore not limited for use as tables, but may be suitable for any other piece of furniture supported by legs.

Of course, other variations of the specific construction and arrangement of the framework assembly disclosed above can be made by those skilled in the art without departing from the invention as defined in the appended claims.

I claim:

1. An assembly for supporting a member to form a furniture piece, said assembly comprising a frame, two spaced leg units connected to the respective ends of said frame to form a sub-assembly, said frame being capable of elastic deformation under the weight of said member to permit relative movement between said leg units to accommodate irregularities in the floor on which the sub-assembly is mounted, means for securing said member to one end of said sub-assembly, and a bracket pivotally mounted to the other end of said sub-assembly for supporting said member relative to said frame in a plurality of angular positions to accommodate said relative movement.

2. A base for supporting a structure on a generally horizontal floor surface comprising first and second spaced apart rigid planar legs, said legs each having an upper edge and two laterally spaced floor surface contacting portions opposite said upper edge, first and second elongate beams spanning the space between said legs, means for rigidly fixing the longitudinal ends of said beams to said legs adjacent said upper edge so that said legs are supported in parallel spaced apart relation and so that substantial medial portions of the beams intermediate said longitudinal ends are unrestricted portions, said beams being parallelly spaced apart, said beams having a thickness to width ratio such that said unrestricted portions of said beams are flexually deformable in torsion with respect to the longitudinal axes thereof, so that said floor surface contacting portions can yield to conform to uneven floor surfaces, the width dimension of said beams being substantially vertical, and means for attaching said structure to said upper edges of said first and second legs.

3. An article of furniture comprising first and second rigid planar legs, at least one elongate beam, said beam being rigidly secured to said legs to support said legs in parallel spaced apart relation so that there is an unrestricted portion intermediate the ends of said beam, said beam having a thickness to width ratio such that said unrestricted portion of said beam is flexurally deformable in torsion with respect to the longitudinal axis thereof, the width dimension of said beam being substantially vertical, means forming a rigid planar surface, and means for attaching said surface forming means relative to said legs, said attaching means being adapted to avoid interference with the flexural movement of said beam so that said rigid legs can conform to uneven floor surfaces.

4. An article of furniture according to claim 3, wherein said attaching means comprises means for immovably fixing said rigid surface forming means relative to said first leg and means for fixing said rigid surface forming means to said second leg for pivotal movement relative thereto.

5. A base for supporting a structure on a generally horizontal floor surface comprising first and second spaced apart rigid planar legs, said legs each having an upper edge and two laterally spaced floor surface contacting portions opposite said upper edge, first and second elongate beams spanning the space between said legs, means for rigidly fixing said beams to said legs so that said legs are supported in parallel spaced apart relation and so that substantial medial portions of the beams intermediate said longitudinal ends are unrestricted portions, said beams being parallelly spaced apart, said beams having a thickness to width ratio such that said unrestricted portions of said beams are flexurally deformable in torsion with respect to the longitudinal axis thereof, so that said floor surface contacting portions can yield to conform to uneven floor surfaces, the width dimension of said beams being substantially vertical, and means for attaching said structure relative to the assembly formed by said beams and said legs.

* * * * *